US009928823B2

(12) United States Patent
Hera et al.

(10) Patent No.: US 9,928,823 B2
(45) Date of Patent: Mar. 27, 2018

(54) ADAPTIVE TRANSDUCER CALIBRATION FOR FIXED FEEDFORWARD NOISE ATTENUATION SYSTEMS

(71) Applicant: Bose Corporation, Framingham, MA (US)

(72) Inventors: Cristian M. Hera, Framingham, MA (US); Hiroshi Miyazaki, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/235,470

(22) Filed: Aug. 12, 2016

(65) Prior Publication Data

US 2018/0047383 A1 Feb. 15, 2018

(51) Int. Cl.
*G10K 11/16* (2006.01)
*G10K 11/178* (2006.01)
(Continued)

(52) U.S. Cl.
CPC ..... *G10K 11/1782* (2013.01); *H04R 3/04* (2013.01); *H04R 29/001* (2013.01);
(Continued)

(58) Field of Classification Search
CPC ..... G10L 21/0208; G10L 15/20; G10L 2021/02165; G10L 25/78; G10L 21/02;
(Continued)

(56) References Cited

U.S. PATENT DOCUMENTS 5,384,853 A 1/1995 Kinoshita et al.
5,410,606 A * 4/1995 Imai ..... G10K 11/1784 381/71.11

(Continued)

FOREIGN PATENT DOCUMENTS

EP 2996112 A1 3/2016

OTHER PUBLICATIONS

Shi-Hwan Oh, Hyoun-suk Kim, and Youngjin Park—"Active control of road booming noise in automotive interiors" center for Noise and Vibration Control (NOVIC), Department of Mechanical Engineering, Korea Advanced Institute of Science and Technology (KAIST), Science Town, Taejon 305-701, Korea~accepted Sep. 27, 2001.

(Continued)

*Primary Examiner* — Norman Yu
(74) *Attorney, Agent, or Firm* — Bose Corporation

(57) ABSTRACT

A method is provided for attenuating road noise in a vehicle cabin. The method includes filtering a noise signal representative of road noise with a first fixed filter to provide an attenuation signal, and filtering the attenuation signal with an adaptive filter to provide a first filtered attenuation signal. The first filtered attenuation signal is provided to an electro-acoustic transducer for transduction to acoustic energy, thereby to attenuate the road noise in a vehicle cabin at an expected position of an occupant's ears. The method also includes receiving a microphone signal representative of the acoustic energy, filtering the attenuation signal with a second fixed filter to provide a second filtered attenuation signal, and updating a set of variable filter coefficients of the adaptive filter based on the microphone signal and the second filtered attenuation signal to accommodate for variations in a transfer function of the speaker.

18 Claims, 3 Drawing Sheets

(51) Int. Cl.
*H04R 3/04* (2006.01)
*H04R 29/00* (2006.01)
*H04B 1/00* (2006.01)

(52) U.S. Cl.
CPC ..... *G10K 2210/12821* (2013.01); *G10K 2210/3027* (2013.01); *G10K 2210/3221* (2013.01); *H04R 2499/13* (2013.01)

(58) Field of Classification Search
CPC . G10L 25/84; G10L 21/0272; G10L 21/0364; G10L 2021/02082; G10L 2021/02161; G10L 21/028; G10L 15/065; G10L 2021/02085; G10K 11/178; G10K 2210/1282; G10K 2210/12821; G10K 11/1782; G10K 11/1786; G10K 11/1784; G10K 11/175; G10K 2210/128; G10K 11/002; G10K 2210/3055; G10K 2210/3211; G10K 15/02; G10K 2210/108; G10K 2210/3023; G10K 2210/3026; G10K 2210/3027; G10K 2210/3046; G10K 2210/3221; G10K 2210/111; G10K 2210/12; G10K 2210/121; G10K 2210/1281; G10K 2210/1283; G10K 2210/3035; G10K 2210/3213; G10K 2210/3218; G10K 2210/3226; G10K 2210/501; H04R 3/005; H04R 2499/13; H04R 2410/05; H04R 1/1083; H04R 2460/01; H04R 1/406; H04R 2410/01; H04R 2410/07; H04R 1/326; H04R 3/00; B60R 11/0247; B60R 25/257
USPC .... 381/71.4, 71.1, 92, 94.1, 71.11, 86, 71.7, 381/71.8, 94.7, 122, 302, 56, 57, 71.12, 381/71.2, 73.1, 94.2; 704/226, 233; 181/206; 340/538.12; 455/63.1
See application file for complete search history.

(56) References Cited

U.S. PATENT DOCUMENTS

| | | | | |
|---|---|---|---|---|
| 7,020,288 | B1 * | 3/2006 | Ohashi | G10K 11/178 381/71.4 |
| 7,254,240 | B2 | 8/2007 | Inoue et al. | |
| 8,077,873 | B2 | 12/2011 | Shridhar et al. | |
| 8,098,837 | B2 | 1/2012 | Inoue et al. | |
| 8,509,452 | B2 | 8/2013 | Yokota | |
| 9,020,158 | B2 | 4/2015 | Wertz et al. | |
| 9,099,075 | B2 | 8/2015 | Sekine et al. | |
| 2006/0188107 | A1 * | 8/2006 | Inoue | G10K 11/1786 381/71.4 |
| 2008/0260174 | A1 * | 10/2008 | Yokota | G10K 11/178 381/71.4 |
| 2011/0142248 | A1 * | 6/2011 | Sakamoto | G10K 11/1784 381/71.4 |
| 2012/0230504 | A1 * | 9/2012 | Kuroda | G10K 11/178 381/71.4 |
| 2014/0153731 | A1 | 6/2014 | Pan | |

OTHER PUBLICATIONS

Cheer, Jordan "Active Control of the Acoustic Environment in an Automobile Cabin" University of Southampton, Faculty of Engineering and the Environment, Institute of Sound and Vibration Research, Thesis for the degree of Doctor of Philiosophy, Dec. 2012.

International Search Report and Written Opinion dated Oct. 30, 2017 for PCT/US2017/042924.

Kuo, S. M. et, al: "Active Noise Control: A Tutorial Review", Proceedings of the IEEE, New York, US, vol. 87, No. 6, Jun. 1999, pp. 943-973, XP011044219, ISSN: 0018-9219, D0I: 10.1109/5.763310 p. 946.

* cited by examiner

ADAPTIVE TRANSDUCER CALIBRATION FOR FIXED FEEDFORWARD NOISE ATTENUATION SYSTEMS

BACKGROUND

This disclosure relates to adaptive transducer calibration for fixed feedforward noise attenuation systems.

SUMMARY

All examples and features mentioned below can be combined in any technically possible way.

This disclosure is based, at least in part, on the realization that a fixed feedforward noise attenuation system can beneficially be provided with an adaptive filter for adaptively equalizing an input to a transducer to account for variations in the transfer function of the transducer.

One aspect provides an active noise attenuation system for cancelling road noise in a vehicle cabin. The system includes an electro-acoustic transducer, a noise sensor for providing a noise signal indicative of road noise, and a first fixed filter configured to modify the amplitude and/or phase of the noise signal thereby to provide an attenuation signal, which, when transduced to acoustic energy via the electro-acoustic transducer, attenuates the road noise at an occupant's ears. A microphone is arranged and configured to sense acoustic energy emitted by the electro-acoustic transducer and to provide a microphone signal corresponding to the sensed acoustic energy. A second fixed filter is configured to filter the attenuation signal and to provide a first filtered attenuation signal. The system further includes an adaptive filter which has a transfer function that is controlled by a set of variable filter coefficients. The adaptive filter is arranged and configured to filter the attenuation signal and to provide a second filtered attenuation signal to the electro-acoustic transducer for transduction to acoustic energy. A coefficient calculator is configured to update the set of variable filter coefficients based on the microphone signal and the first filtered attenuation signal, thereby to accommodate for variations in a transfer function of the speaker.

Implementations may include one of the following features, or any combination thereof.

In some implementations, the system includes a headrest that supports the electro-acoustic transducer and the microphone.

In certain implementations, the noise sensor is mounted external to a vehicle for sensing road noise.

In some cases, the first fixed filter has a transfer function defined by a set of fixed filter coefficients, and wherein the transfer function of the first fixed filter models and accommodates for an expected transfer function of the electro-acoustic transducer as well as a transfer function of the acoustic path between the electro-acoustic transducer and an expected position of the occupant's ears.

In certain cases, the second fixed filter has a transfer function defined by a set of fixed filter coefficients, and the transfer function of the second fixed filter models and accommodates for an estimate of a transfer function of the acoustic path between the electro-acoustic transducer and the microphone.

In some examples, the noise sensor is selected from the group consisting of: an accelerometer, a microphone, and combinations thereof.

In certain examples, the first fixed filter is implemented as a filter type selected from the group consisting of a finite impulse response filter and an infinite impulse response filter.

In some implementations, the second fixed filter is implemented as a filter type selected from the group consisting of a finite impulse response filter and an infinite impulse response filter.

In certain implementations, the adaptive filter is implemented as a filter type selected from the group consisting of a finite impulse response filter or an infinite impulse response filter.

In some cases, the coefficient calculator employs an adaptive algorithm selected from the group consisting of a least mean squares (LMS) adaptive algorithm, NLMS, RLS and its fast versions, and an affine projection algorithm.

Another aspect features one or more machine-readable storage devices having encoded thereon computer readable instructions for causing one or more processors to perform operations including filtering a noise signal representative of road noise with a first fixed filter to provide an attenuation signal, and filtering the attenuation signal with an adaptive filter to provide a first filtered attenuation signal. The first filtered attenuation signal is provided to an electro-acoustic transducer for transduction to acoustic energy, thereby to attenuate the road noise in a vehicle cabin at an expected position of an occupant's ears. The operations also include receiving a microphone signal representative of the acoustic energy, filtering the attenuation signal with a second fixed filter to provide a second filtered attenuation signal, and updating a set of variable filter coefficients of the adaptive filter based on the microphone signal and the second filtered attenuation signal to accommodate for variations in a transfer function of the speaker.

Implementations may include one of the above and/or below features, or any combination thereof.

In another aspect, a method is provided for attenuating road noise in a vehicle cabin. The method includes providing a noise signal representative of road noise, filtering the noise signal with a first fixed filter to provide an attenuation signal, and filtering the attenuation signal with an adaptive filter to provide a first filtered attenuation signal. The method also includes transducing the first filtered attenuation signal to acoustic energy via an electro-acoustic transducer, thereby to attenuate the road noise in a vehicle cabin at an expected position of an occupant's ears. The acoustic energy is sensed with a microphone, and a microphone signal representative of the acoustic energy is provided. The method further includes filtering the attenuation signal with a second fixed filter to provide a second filtered attenuation signal, and updating a set of variable filter coefficients of the adaptive filter based on the microphone signal and the second filtered attenuation signal, thereby to accommodate for variations in a transfer function of the speaker.

Implementations may include one of the above and/or below features, or any combination thereof.

In some implementations, transducing the first filtered attenuation signal includes transducing the first filtered attenuation signal via an electro-acoustic transducer supported in a vehicle headrest.

In certain implementations, sensing the acoustic energy includes sensing the acoustic energy with a microphone supported in a vehicle headrest.

DETAILED DESCRIPTION

Figure 1:
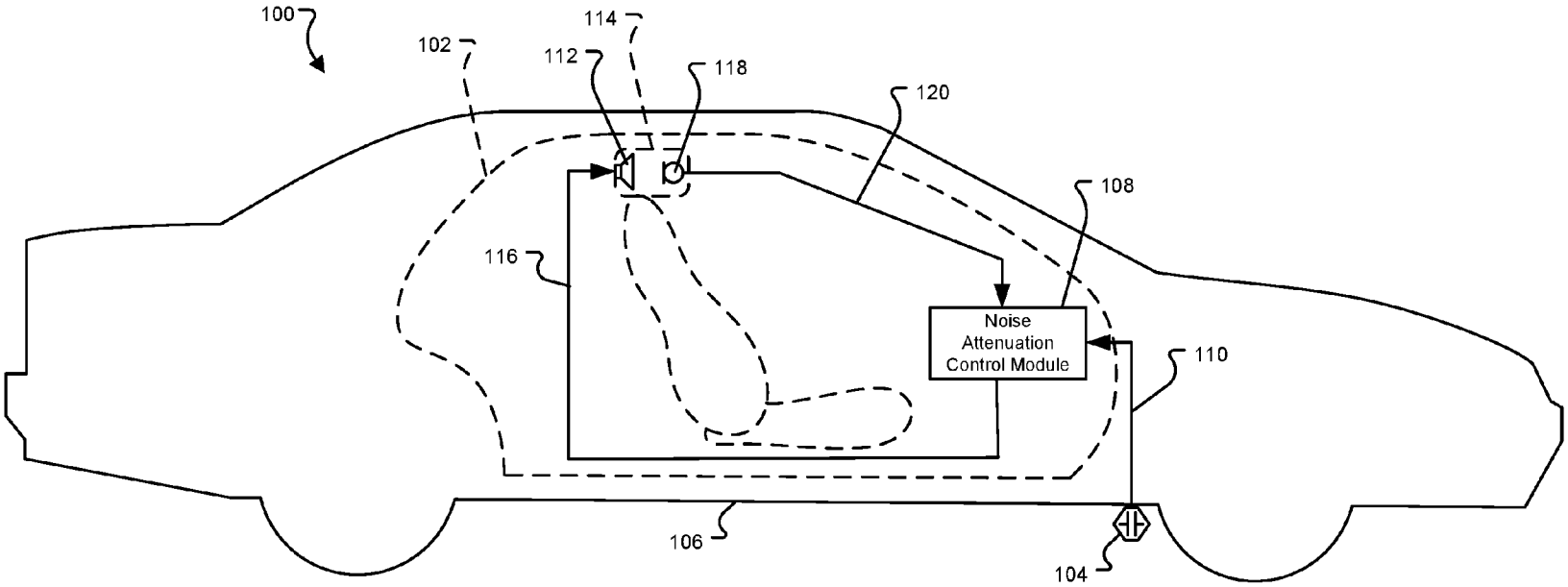
FIG. 1 is a diagram of an active noise attenuation system for cancelling road noise in a vehicle cabin.

Though the elements of several views of the drawing may be shown and described as discrete elements in a block diagram and may be referred to as "circuitry" or "modules", unless otherwise indicated, the elements may be implemented as one of, or a combination of, analog circuitry, digital circuitry, or one or more microprocessors executing software instructions. The software instructions may include digital signal processing (DSP) instruction. Unless otherwise indicated, signal lines may be implemented as discrete analog or digital signal lines. Multiple signal lines may be implemented as one discrete difficult signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or DSP techniques and are included within the scope of this patent application. Unless otherwise indicated, audio signals may be encoded in either digital or analog form; conventional digital-to-analog and analog-to-digital converters may not be shown in circuit diagrams.

This disclosure relates to an adaptive transducer calibration for a fixed feedforward noise cancellation system. The system uses an adaptive filter to account for changes in the transfer function of a speaker attributable to age, temperature, humidity and/or variations between individual transducers of the same make and model, e.g., due to manufacturing tolerances.

Figure 2:
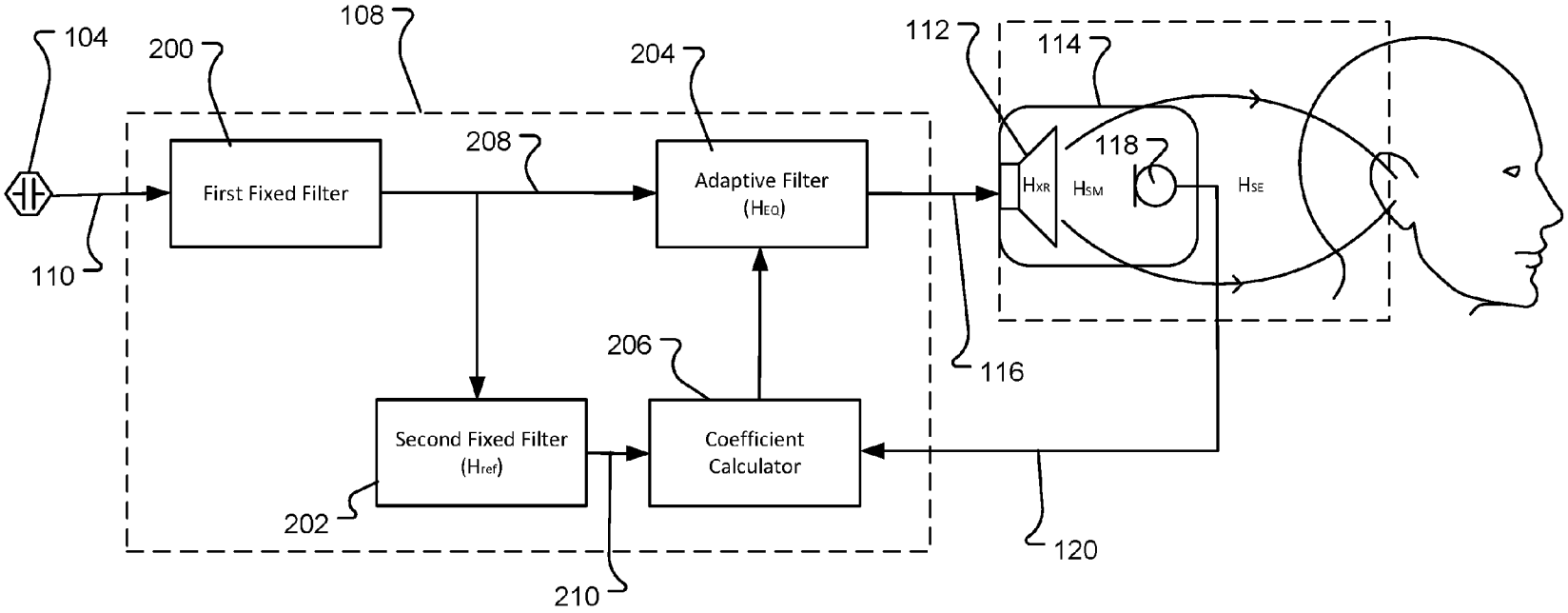
FIG. 2 is a block diagram showing an example of a configuration of a noise attenuation control module from the system of FIG. 1.
Figure 3:
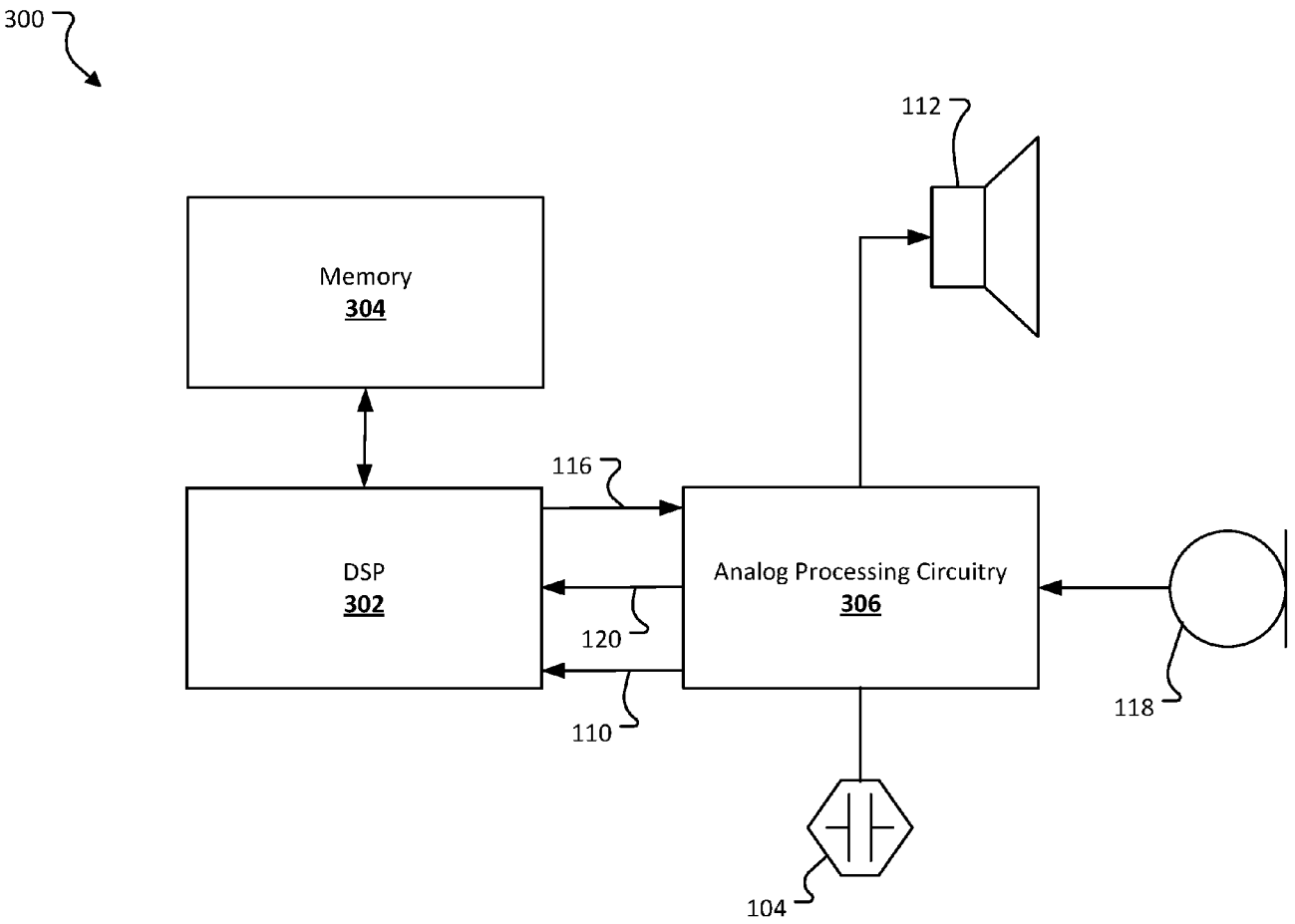
FIG. 3 is a diagram of circuitry for implementing the system of FIG. 1.

FIGS. 1-3 illustrate an exemplary implementation of an adaptive feedforward system 100 for road noise cancellation in a vehicle cabin 102. In FIG. 1, a noise sensor 104 (e.g., accelerometer or a microphone) for detecting road noise is mounted external to a vehicle body 106. The noise sensor 104 provides, to a noise attenuation control module 108, a noise signal 110 representative of the detected road noise. The system 100 includes one or more electro-acoustic transducers 112, which are mounted in a vehicle headrest 114. The electro-acoustic transducer 112 produces acoustic energy toward the vehicle cabin 102 in accordance with a noise attenuation signal 116 provided from the noise attenuation control module 108. In some cases, electro-acoustic transducers may be provided in each of plural headrests in the vehicle for providing acoustic energy to cancel road noise at respective seating positions (i.e., at the ears of the occupant of the vehicle seat to which the corresponding headrest is attached).

One or more microphones 118 for detecting the acoustic energy produced by the electro-acoustic transducer 112 are mounted to the vehicle headrest 114. The headrest mounted microphone 118 provides a microphone signal 120 representative of the acoustic energy to the noise attenuation control module 108. The noise attenuation control module 108 adaptively modifies an equalization of the electro-acoustic transducer 112 by adjusting filtering applied to the noise cancellation signal 116, thereby to compensate for variations in a transfer function of the electro-acoustic transducer 112.

Referring to FIG. 2, the noise attenuation control module 108 includes a first fixed filter 200, a second fixed filter 202, an adaptive filter 204, and a coefficient calculator 206. The noise signal 110 from the sensor 104 is passed to the first fixed filter 200. The first fixed filter 200 is configured to modify the amplitude and/or phase of the noise signal 100 in order to provide the attenuation signal 208, which, when transduced to acoustic energy via the electro-acoustic transducer 112, attenuates road noise at an occupant's ears.

The first fixed filter 200 is defined by a set of fixed filter coefficients. The first fixed filter 200 may be implemented as filter type selected from the group consisting of a finite impulse response (FIR) filter, and an infinite impulse response (IIR) filter. The first fixed filter 200 models and accommodates for an estimate of a transfer function $H_{XR}$ of the electro-acoustic transducer as well as the transducer to ear $H_{SE}$ transfer function (i.e., the transfer function of the audio path from the electro-acoustic transducer to the expected position of the occupant's ear). Those transfer functions may be determined at the time of tuning of an audio system in a model vehicle. For the best performance possible, all vehicles that the system will be deployed in should have transducers with an identical transfer function to the ones measured in the vehicle that the system was tuned in, at temperature and humidity the measurement was taken.

As mentioned above, there may be significant changes in the transducer transfer function $H_{XR}$ between similar parts (same make/model transducer), e.g., due to manufacturing tolerances. The transfer function of the electro-acoustic transducer 112 may also change with temperature and/or humidity. The transfer function may also change over time due to age. These variations of the transducer transfer function $H_{XR}$ can contribute to compromised performance of the system. To compensate for these variations, the system includes the adaptive filter 204 and the coefficient calculator 206.

The adaptive filter 204 has a transfer function HEQ that is controlled by a set of variable filter coefficients. The adaptive filter 204 is arranged and configured to filter the attenuation signal 208 and to provide the filtered attenuation signal 116 to the electro-acoustic transducer 112 for transduction to acoustic energy. The adaptive filter 204 may be implemented as a filter type selected from the group consisting of: a finite impulse response (FIR) filter, and an infinite impulse response (IIR) filter.

The coefficient calculator 206 is configured to update the set of variable filter coefficients of the adaptive filter 204 to accommodate for variations in the transducer transfer function $H_{XR}$. The coefficient calculator 206 updates the filter coefficients based on an adaptive algorithm. Suitable adaptive algorithms for use by the coefficient calculator 206 may be found in *Adaptive Filter Theory, 4th Edition* by Simon Haykin, ISBN 013091261, and include a least mean square (LMS). Other suitable algorithms include a normalized least-mean-square (NLMS) algorithm, recursive least squares (RLS) algorithm and its fast versions, and an affine projection algorithm.

In operation, the headrest microphone 118 detects acoustic energy from the electro-acoustic transducer 112, as modified by the transducer to microphone actual transfer function $H_{SM}$, and provides a corresponding microphone signal 120 to the coefficient calculator 206. The second fixed filter 202 is provided for filtering the attenuation signal 208 and for providing the second filtered attenuation signal 210 to the coefficient calculator 206. The second fixed filter 202 is defined by a set of fixed filter coefficients. The second fixed filter 202 may be implemented as filter type selected from the group consisting of a finite impulse response (FIR) filter, and an infinite impulse response (IIR) filter.

The second fixed filter 202 is characterized by a transfer function $H_{ref}$ which corresponds to an estimate of the transducer to microphone transfer function. $H_{ref}$ is the transfer function measured in the reference car, for which the first fixed filter 200 was computed. The coefficient calculator 206 uses the signals 210,120 provided from the second fixed filter 202 and the microphone 118 to update the coefficients for the adaptive filter 204 in order to compensate for any difference between $H_{ref}$ and $H_{SM}$.

The microphone 118 is mounted in close proximity to the electro-acoustic transducer 112 such that the signal-to-noise ratio (i.e., the ratio of the acoustic energy from the electro-acoustic transducer to the acoustic noise or other perturbing signals in the vehicle cabin as picked up by the microphone) in the microphone signal is high. Since the microphone 118 is mounted in close proximity to the electro-acoustic transducer 112, and the signal-to-noise ratio (SNR) is sufficiently high, variations in the acoustic path between the microphone and the electro-acoustic transducer are expected to be negligible. Thus, any difference between $H_{ref}$ and $H_{SM}$ can be considered attributable to a variation in the transducer transfer function $H_{XR}$.

FIG. 3 is a diagram of an implementation of a feedforward noise attenuation system 300. In this implementation, the system 300 includes a digital signal processor (DSP) 302, a memory 304, analog processing circuitry 306, the electro-acoustic transducer 106, the noise sensor, and the microphone 108. The DSP 302 may be configured to implement the first and second fixed filters, the adaptive filter, and the coefficient calculator, shown in FIG. 2. The memory 304 provides storage for program codes and data used by the DSP 302. The analog processing circuitry 306 performs analog processing and may include a D/A converter for converting a digital output from the DSP to an analog input for the transducer; one or more A/D converters for converting analog outputs from the microphone and/or the noise sensor to digital inputs; and one more power amplifiers for amplifying analog signals in the signal paths.

A number of implementations have been described. Nevertheless, it will be understood that additional modifications may be made without departing from the scope of the inventive concepts described herein, and, accordingly, other implementations are within the scope of the following claims.

For example, the adaptive filtering techniques described above may also be applicable to engine harmonic cancellation systems by reducing transducer to error microphone transfer function variations.

While implementations have been described in which the transducer and microphone are collocated within a headrest, other implementations are possible. In some implementations, for example, the transducer and microphone may be collocated in the vehicle headliner above an associated seating position.

What is claimed is:

1. An active noise attenuation system for cancelling road noise in a vehicle cabin comprising:

an electro-acoustic transducer having an expected transfer function;

a noise sensor for providing a noise signal indicative of road noise;

a first fixed filter configured to modify the amplitude and/or phase of the noise signal thereby to provide an attenuation signal, which, when transduced to acoustic energy via the electro-acoustic transducer, attenuates the road noise at an occupant's ears, wherein the first fixed filter has a transfer function defined by a set of fixed filter coefficients, and wherein the transfer function of the first fixed filter models and accommodates for the expected transfer function of the electro-acoustic transducer as well as a transfer function of the acoustic path between the electro-acoustic transducer and an expected position of the occupant's ears;

a microphone arranged and configured to sense acoustic energy emitted by the electro-acoustic transducer and to provide a microphone signal corresponding to the sensed acoustic energy;

a second fixed filter configured to filter the attenuation signal and to provide a first filtered attenuation signal;

an adaptive filter having a transfer function controlled by a set of variable filter coefficients, the adaptive filter being arranged and configured to filter the attenuation signal and to provide a second filtered attenuation signal to the electro-acoustic transducer for transduction to acoustic energy; and a coefficient calculator configured to update the set of variable filter coefficients based on the microphone signal and the first filtered attenuation signal, thereby to accommodate for variations in the expected transfer function of the electro-acoustic transducer itself.

2. The active noise attenuation system of claim 1, further comprising a headrest supporting the electro-acoustic transducer and the microphone.

3. The active noise attenuation system of claim 1, wherein the noise sensor is mounted external to a vehicle for sensing road noise.

4. The active noise attenuation system of claim 1, wherein the second fixed filter has a transfer function defined by a set of fixed filter coefficients, and wherein the transfer function of the second fixed filter models and accommodates for an estimate of a transfer function of the acoustic path between the electro-acoustic transducer and the microphone.

5. The active noise attenuation system of claim 1, wherein the noise sensor is selected from the group consisting of: an accelerometer, a microphone, and combinations thereof.

6. The active noise attenuation system of claim 1, wherein the first fixed filter is implemented as a filter type selected from the group consisting of a finite impulse response filter and an infinite impulse response filter.

7. The active noise attenuation system of claim 1, wherein the second fixed filter is implemented as a filter type selected from the group consisting of a finite impulse response filter and an infinite impulse response filter.

8. The active noise attenuation system of claim 1, wherein the adaptive filter is implemented as a filter type selected from the group consisting of a finite impulse response filter or an infinite impulse response filter.

9. The active noise attenuation system of claim 1, wherein the coefficient calculator employs an adaptive algorithm selected from the group consisting of a least mean squares (LMS) adaptive algorithm, NLMS, RLS and its fast versions, and an affine projection algorithm.

10. One or more non-transitory machine-readable storage devices having encoded thereon computer readable instructions for causing one or more processors to perform operations comprising:

filtering a noise signal representative of road noise with a first fixed filter to provide an attenuation signal, wherein the first fixed filter has a transfer function defined by a set of fixed filter coefficients, and wherein the transfer function of the first fixed filter models and accommodates for an expected transfer function of an electro-acoustic transducer as well as a transfer function of the acoustic path between the electro-acoustic transducer and an expected position of the occupant's ears;

filtering the attenuation signal with an adaptive filter to provide a first filtered attenuation signal;

providing the first filtered attenuation signal to the electro-acoustic transducer for transduction to acoustic energy, thereby to attenuate the road noise in a vehicle cabin at an expected position of an occupant's ears;

receiving a microphone signal representative of the acoustic energy;

filtering the attenuation signal with a second fixed filter to provide a second filtered attenuation signal; and updating a set of variable filter coefficients of the adaptive filter based on the microphone signal and the second filtered attenuation signal, thereby to accommodate for variations in the expected transfer function of the electro-acoustic transducer itself.

11. The one or more machine-readable storage devices of claim 10, wherein the second fixed filter has a transfer function defined by a set of fixed filter coefficients, and wherein the transfer function of the second fixed filter models and accommodates for an estimate of a transfer function of the acoustic path between the electro-acoustic transducer and the microphone.

12. The one or more machine-readable storage devices of claim 10, wherein the first fixed filter is implemented as a filter type selected from the group consisting of a finite impulse response filter and an infinite impulse response filter.

13. The one or more machine-readable storage devices of claim 10, wherein the second fixed filter is implemented as a filter type selected from the group consisting of a finite impulse response filter and an infinite impulse response filter.

14. The one or more machine-readable storage devices of claim 10, wherein the adaptive filter is implemented as a filter type selected from the group consisting of a finite impulse response filter and an infinite impulse response filter.

15. A method for attenuating road noise in a vehicle cabin, the method comprising:

providing a noise signal representative of road noise;

filtering the noise signal with a first fixed filter to provide an attenuation signal, wherein the first fixed filter has a transfer function defined by a set of fixed filter coefficients, and wherein the transfer function of the first fixed filter models and accommodates for an expected transfer function of an electro-acoustic transducer as well as a transfer function of the acoustic path between the electro-acoustic transducer and an expected position of the occupant's ears;

filtering the attenuation signal with an adaptive filter to provide a first filtered attenuation signal;

transducing the first filtered attenuation signal to acoustic energy via the electro-acoustic transducer, thereby to attenuate the road noise in a vehicle cabin at an expected position of an occupant's ears;

sensing the acoustic energy with a microphone;

providing a microphone signal representative of the acoustic energy;

filtering the attenuation signal with a second fixed filter to provide a second filtered attenuation signal; and updating a set of variable filter coefficients of the adaptive filter based on the microphone signal and the second filtered attenuation signal, thereby to accommodate for variations in the expected transfer function of the electro-acoustic transducer itself.

16. The method of claim 15, wherein transducing the first filtered attenuation signal comprises transducing the first filtered attenuation signal via an electro-acoustic transducer supported in a vehicle headrest.

17. The method of claim 15, wherein the microphone is supported in a vehicle headrest.

18. The method of claim 15, wherein the second fixed filter has a transfer function defined by a set of fixed filter coefficients, and wherein the transfer function of the second fixed filter models and accommodates for an estimate of a transfer function of the acoustic path between the electro-acoustic transducer and the microphone.

* * * * *